US008905487B2

(12) United States Patent
Graham

(10) Patent No.: US 8,905,487 B2
(45) Date of Patent: Dec. 9, 2014

(54) MINE EQUIPMENT RECOVERY SYSTEM

(71) Applicant: Robert Wayne Graham, Whitman, VA (US)

(72) Inventor: Robert Wayne Graham, Whitman, VA (US)

( * ) Notice: Subject to any disclaimer, the term of this patent is extended or adjusted under 35 U.S.C. 154(b) by 1 day.

(21) Appl. No.: 13/662,826

(22) Filed: Oct. 29, 2012

(65) Prior Publication Data

US 2013/0104768 A1 May 2, 2013

Related U.S. Application Data

(60) Provisional application No. 61/552,915, filed on Oct. 28, 2011.

(51) Int. Cl.
*E21F 13/00* (2006.01)
*E21C 35/24* (2006.01)

(52) U.S. Cl.
CPC ..... *E21F 13/00* (2013.01); *E21F 13/006* (2013.01); *E21C 35/24* (2013.01)
USPC ..... 299/30; 299/1.05; 299/95

(58) Field of Classification Search
CPC ..... E21C 35/24; E21F 13/00; E21F 13/006
USPC ..... 299/1.05, 1.4, 1.9, 30, 64, 67, 95
See application file for complete search history.

(56) References Cited

U.S. PATENT DOCUMENTS 2,664,217 A * 12/1953 Arentzen ..... 414/743
2,826,402 A 5/1958 Alspaugh et al.
4,192,551 A 3/1980 Weimer et al.
4,240,665 A * 12/1980 Hubbard et al. ..... 299/31
4,281,876 A 8/1981 Lansberry
4,323,280 A 4/1982 Lansberry et al.
4,465,155 A * 8/1984 Collins ..... 180/169
4,708,395 A 11/1987 Petry et al.
5,003,236 A 3/1991 Harless
5,364,171 A 11/1994 Addington et al.
5,609,397 A 3/1997 Marshall et al.
5,682,312 A 10/1997 Rocke
5,709,433 A 1/1998 Christopher et al.
6,109,699 A 8/2000 Mraz
6,270,163 B1 8/2001 Mullet et al.
6,305,296 B1 * 10/2001 Wilkinson et al. ..... 105/133
6,336,684 B1 1/2002 Turner
6,633,800 B1 10/2003 Ward et al.
7,350,876 B2 * 4/2008 Burgess et al. ..... 299/95

(Continued)

*Primary Examiner* — David Bagnell
*Assistant Examiner* — Michael Goodwin
(74) *Attorney, Agent, or Firm* — Waters Law Group, PLLC; Brian W. Foxworthy; Robert R. Waters

(57) ABSTRACT

An equipment recovery system for high risk environments such as high wall mine shafts has a vehicle that rides on a track including applications where a push-beam conveyor may serve as the track. The vehicle has a guide to keep it on the track and a hitch for attaching a recovery cable. The vehicle is remotely operated from outside the mine, has a power train for moving the vehicle, an implement for performing tasks, and carries an onboard power source and electrical control boxes to power and control the vehicle and implement. The vehicle may communicate with an outside operator station via an Ethernet cable and may employ and Ethernet extender for that purpose. The vehicle may have a camera to transmit video images. The vehicle may be operated from a high wall miner control center or from an operator station on a self propelled support vehicle.

19 Claims, 9 Drawing Sheets

(56) References Cited

U.S. PATENT DOCUMENTS

| | | | | |
|---|---|---|---|---|
| 7,499,804 | B2 | 3/2009 | Svendsen et al. | |
| 7,594,702 | B2 | 9/2009 | Lowery | |
| 7,937,104 | B2 * | 5/2011 | Lintula et al. | 455/525 |
| 8,090,491 | B2 | 1/2012 | Barfoot et al. | |
| 2007/0096538 | A1 * | 5/2007 | Niemi et al. | 299/1.05 |
| 2010/0259091 | A1 | 10/2010 | Hackelboerger et al. | |
| 2010/0308639 | A1 * | 12/2010 | Cushman | 299/18 |
| 2012/0035798 | A1 | 2/2012 | Barfoot et al. | |

* cited by examiner

MINE EQUIPMENT RECOVERY SYSTEM

RELATED APPLICATIONS

This application claims priority from U.S. Provisional Application No. 61/552,915, filed on Oct. 28, 2011. The entire disclosure contained in U.S. Provisional Application 61/552,915, including the attachments thereto, is incorporated herein by reference.

FIELD OF INVENTION

This invention is related to remote controlled vehicles for mine maintenance and service. More particularly this invention is related to a remote controlled vehicle that rides on the push beams in high-wall mining shafts.

BACKGROUND OF THE INVENTION

One example of an application for the apparatus of the present invention is highwall mining. During the past forty years, highwall mining has proven to be an efficient method of mining coal, or other sought after material, that would not be mined by other methods. Highwall mining is a form of mining frequently used to supplement strip mining.

Strip mining is used when the sought after material deposits, such as coal, occur relatively close to the surface. In strip mining, the top several layers of earth over a coal deposit are removed to gain access to the coal deposit. The material of the covering layers is called overburden. When the coal to overburden ratio falls below a certain ratio, the process becomes unprofitable and strip mining ceases to be the economically preferred technique at that location. At that point in time, the strip mining has produced a large pit with seams of coal extending from the surface of the walls of the pit back into the earth. Highwall mining is a type of mining used to extract, or mine, the coal in the seams terminating at the walls of the pit.

In highwall mining, a highwall mining machine is located on the pit floor in alignment with a coal seam and a remote operated cutter module is forced into the coal seam. The cutter cuts a series of parallel rectangular cuts back into the seam up to 1,000 feet from the face of the wall. This is considered too dangerous for the insertion of any personnel and the cutter modules are directed and operated remotely. The coal mined by the cutter module is transported from the cutter module to the surface area by augers or conveyor belt systems.

Typically, the cuts and the entries to the cuts are rectangular. The width of the entry to a cut is dependent on the type of cutter module used, and the width may vary from 9-½ feet to 12 feet. The height of the entry is more dependent on the coal seam's thickness, and the height may vary from 28 inches to more than 15 ft.

As the high-wall miner progresses back into the mountain, a specialized form of conveyor is built behind it. This conveyor is comprised of multiple sections of push-beams. These push-beams are low profile and hollow on their interior. Within their hollow interior is at least one auger, but most typically, there are two augers. The first push-beam behind the high-wall miner receives coal, or other mined material from the high-wall miner and the augers within this first push-beam pulls the material back towards the push-beam behind it. Each push-beam receives the mined material from the one preceding it in the mine and the augers within it pull the material onward out of the mine until the material is conveyed fully out of the mine to a station at the floor of the mine pit. The augers are usually driven by the station at the exit of the mine shaft. As the mining machine recedes further underground, additional push-beams are added and pushed back in along with the machine.

This is a highly automated process and no personnel are allowed back into the high-wall mine shaft. The high-wall miner and the push-beam augers are operated and powered from the station external to the high-wall mine shaft. On occasion, the high-wall miner may become lodged in the high-wall mine shaft or some problem may arise with the push-beam conveyor back in the high-wall mine shaft. When this occurs, personnel are not allowed in to troubleshoot or inspect the source of the problem. Therefore, operators are left to blindly manipulate the high-wall miner to attempt to free it. This is frequently not successful. This can result in a highly expensive piece of capital equipment being irretrievably lodged within the high-wall mine shaft. There is a need for an apparatus which can travel back into the high-wall mine shaft and provide a visual of the situation as well as having the capabilities to perform certain functions to free the high-wall miner from its lodged position. Alternatively, the apparatus could disconnect the high-wall miner from the push-beam conveyor system, as the push-beam conveyor is itself a highly expensive piece of equipment. Each section of push-beam conveyor that can be retrieved would by itself provide a considerable savings even if the high-wall miner itself were lost.

At present time, it is estimated that there are more than one hundred highwall miners being operated in the coal industry, each one producing multiple cuts during an operating day. They all have the same problems to varying degrees. A need exists for a system capable of recovering, or assisting, lodged high wall mining machines and associated conveyors. Substantial monetary gains may be achieved by recovering the lodged components. In some cases, the seam being mined may be more fully exploited when the miner is freed or otherwise serviced.

Additionally, once a disabled miner, and or conveyor, is recovered and the cut cleared, a highwall miner can return to the cut to further exploit the seams at that location for further monetary benefit. For monetary purposes, the system must be efficient, reliable, and not labor intensive. For safety purposes, the system must not require personnel to be exposed at or near the highwall of the pit. The system should be able to work in close proximity with high wall miners.

Relevant Art

U.S. Pat. No. 6,633,800 by Ward is for a "Remote control system." An apparatus and method for a control unit allows for autonomous, manual and tele-operation of mining vehicles. The control unit has a robust system design to withstand the harsh environment of underground mines. The control unit allows a tele-operator, in a remote tele-operator station, to use image and operational data, joysticks and foot pedals to remotely control the mining vehicle. In another aspect, the control unit provides safety features such as supervising its operation for operational errors and providing status, warning and error information to the tele-operator station.

U.S. Pat. No. 6,109,699 by Mraz is for a "Tow Line Equipped Remote Mining Machine and Method." Mraz discloses a method and apparatus for advancing cables and hoses to a remotely operated mining machine and retrieval of the machine in the case of accident. The apparatus supports remote haulage of material in a self-propelled vehicle guided within a mine opening, so as to avoid interference with cables and hoses and the walls of the mine opening.

U.S. Pat. No. 4,708,395 by Petry, et al. is for a "Remotely sensing of excavation cavity during mining." Petry discloses a method and apparatus for hydraulically mining a location using a hydraulic monitor which has a horizontal and vertical positionable control apparatus. The hydraulic monitor is connected to a source of high pressure water. Distance and direction measuring equipment are mounted on the monitor and controlled in a manner to scan the location. The output from the distance and direction measuring equipment is inputted to a computer and a visual video display monitor. The computer converts the information from the distance and direction measuring equipment to a visual representation of the cavity being mined. The hydraulic monitor includes a means for diverting the high velocity jet during the distance measuring period so that the water pressure is not varied in the high pressure pipe, and the mined material is continuously washed toward the collection apparatus during the measuring period. All hydraulic monitor functions are controlled from the remote operator location.

U.S. Pat. No. 4,192,551 by Weimer, et al. is for "Remote control system for mining machines." Weimer discloses a system that controls all miner hydraulic and electrical functions from a hand held miner remote control pendant. Pendant control devices provide on/off control signals to interfaces with miner drive and pump controllers, as well as a group of +−6 VDC differential proportional and on/off control signals to respective electronic valve drivers. Valve driver outputs are fed to respective force motors on pilot stage valves which control each hydraulic function. Each valve driver output is modified by offset and dither signals to overcome power stage valve dead band and frictional characteristics. Pilot stage valves have an internal feedback sleeve co-acting with a pilot valve spool in a hydraulic servo circuit. Pilot stage valves operate in a pilot oil system which may be isolated from power oil systems.

SUMMARY

In at least one embodiment of the invention, a vehicle frame approximately the width of the push-beam conveyor has multiple axels along its length. These axels run transverse to the push-beam conveyor, across the vehicle body. Each axel has multiple wheels upon it and these wheels are spaced to accommodate features in the push-beam conveyor section, so that the vehicle can ride on top of the push-beam conveyor as a track. For example, some types of push-beam conveyors have troughs in them for accommodating power cables, hydraulic cables, and other elements for servicing the high-wall mining machine, and in some cases, the push-beam conveyor sections.

The surface control station includes many components to allow the system a high level of independent operation. As a foundation, all of the other components of the surface control station are located on a wheeled chassis. In some embodiments, this wheeled chassis may be a trailer. This wheeled chassis is highway ready with all required safety features as well as a suitable hitch when necessary, such as a fifth wheel type hitch, for connecting to a highway vehicle. The wheeled chassis also has stabilizing capabilities, such as outriggers, for operating at mine sites. Among the components that may be located on the wheeled chassis are: an operator station with controls and monitoring screens; an electrical generator; a hydraulic power unit; a battery charger; a transformer; circuit breakers; an air compressor; a crane; a battery charging station; a retrieval winch; an electric welder; and an optical alignment device, such as a laser alignment device. A cable on the retrieval winch attaches to the recovery vehicle to retrieve it should the vehicle become disabled, and the optical alignment device provides an efficient gauge for aligning the surface control station with a respective highwall cut to keep the retrieval winch and cable effective.

Because the high-wall mining machine follows the coal seam, the path of the high-wall mining shaft may vary up and down. This can cause the push-beam conveyors to form an irregular track for a vehicle that may try to ride upon the conveyor. In at least one embodiment of the invention, the vehicle body has at least one hinge along its length so that it may more easily follow the undulations of the push-beam conveyor. The vehicle frame of the remote controlled service vehicle carries a variety of components for several systems.

A hydraulic pump driven by an electric pump motor provides hydraulic power for the various motive elements of the recovery vehicle, such as hydraulic cylinders and motors, while a programmable controller operates a hydraulic manifold to convert signals from the surface control stations to actions of the recovery vehicle. For control purposes, a signal cable connects the recovery vehicle to the surface control station. A reel at the surface control station carries the signal cable and turns to take up and feed out the cable as the equipment recovery vehicle travels. On some embodiments, a moving guide would wind the cable on the reel in a balanced or level manner. A camera mounted on the equipment recovery vehicle provides information for an operator on screens at the operator station. The camera provides a forward view in front of the equipment recovery vehicle to allow an operator to access the status within the mine shaft.

Additionally, some embodiments of the equipment recovery vehicle have an operable recovery implement capable of remote operation by an operator, and at least one embodiment of the recovery vehicle will have a towing feature. The particular recovery implement on the recovery vehicle will depend on the particular application. To free a piece of equipment, the implement may be a hydraulic hammer. To cut away the push-beam conveyor, the implement may be a saw. To clean up fallen rock, the implement may be a pulverizer. For coal or material recovery, the recovery implement may be a scoop. For equipment recovery, the recovery implement may be a grapple, manipulator, cutter, or a combination of these.

BRIEF DESCRIPTION OF THE DRAWINGS

Additional utility and features of the invention will become more fully apparent to those skilled in the art by reference to the following drawings, which illustrate some of the primary features of preferred embodiments.

DESCRIPTION OF THE EMBODIMENT(S)

Figure 1:
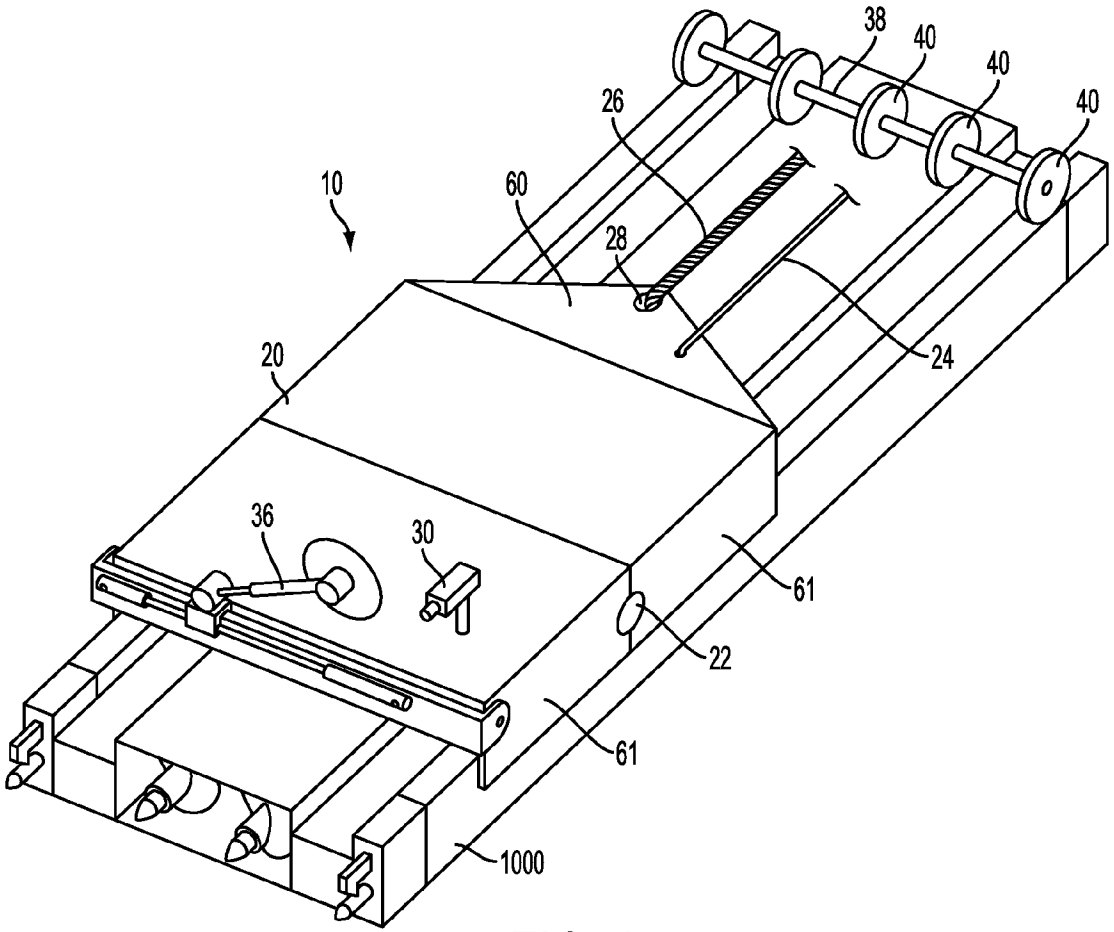
FIG. 1 is a perspective view of the tram portion of an embodiment of an equipment retrieval apparatus positioned on high-wall mining push beams.

FIG. 1 is a perspective view of the equipment recovery vehicle portion 20 of the equipment recovery system 10 shown positioned on a high-wall mining push-beam conveyor 1,000, which, in the embodiment of FIG. 1, is utilized as a track for recovery vehicle 20. In FIG. 1 equipment recovery vehicle 20 is enclosed for the most part, and in the embodiment shown in FIG. 1 hinged toward the middle of its body. Hinge 22 in equipment recovery vehicle 20 allows equipment recovery vehicle 20 to adjust to the irregularities along the push-beam conveyor. Equipment recovery vehicle 20 is remotely operated and to that end, communication, or data, cable 24 connects at the rear equipment recovery vehicle 20. Communication cable 24 transmits instructions from a remote operator center to equipment recovery vehicle 20 and transmits information from equipment recovery vehicle 20 back to a remote operator center. Should equipment recovery vehicle 20 become disabled within the mine shaft, wire rope 26 attached to connecting point or hitch 28 on equipment recovery vehicle 20 allows equipment recovery vehicle 20 to be retrieved by a winch outside the high-wall mine shaft. Camera 30 mounted at the front of equipment recovery vehicle 20 provides images of the interior of the mine shaft to the operator located back at an exterior operator center. This information is transmitted over communication cable 24.

Component mounting plate 32 is attached to tilt plate 34 (see FIGS. 3 and 4) which is attached at the front of equipment recovery vehicle 20. Component mounting plate 32 is capable of shifting back and forth along tilt plate 34 and provides a location for mounting components and implements. To complement the linear shifting back and forth of component mounting plate 32, tilt plate 34 is capable of pivoting upward and downward. The combination of the shift capabilities of component mounting plate 32 and the pivot capabilities of tilt plate 34 allows for positioning and directing of components attached to component mounting plate 32.

Component 36 mounts to component mounting plate 32 at the front of equipment recovery vehicle 20. In the embodiment shown in FIG. 1, component 36 is a hydraulically powered cut-off saw. When the high-wall miner or extended parts of the push-beam conveyor become hopelessly lodged within the high-wall mine shaft, the entire push-beam conveyor may be lost because the push-beam conveyor sections are interconnected with each other. Each section of push-beam conveyor is itself very expensive. In FIG. 1, the component is a cut-off saw which could be used to cut the connecting elements between two push-beams. This would allow the push-beams behind the trouble spot to be pulled back out of the high-wall mine shaft. Although the miner and other sections of the push-beams may be lost, the recovery of a substantial portion of the push-beam conveyor would constitute a substantial financial recovery.

Although mounted component 36 in FIG. 1 is shown as a hydraulically powered cut-off saw, other implements or components could be mounted. These possible alternative or additional components or implements could include: a grapple; a secondary pull riser; a scoop or bucket; and an excavating hammer or jack hammer, along with other possible components or implements. The grapple would allow an operator outside the mine shaft to engage in and move objects such as fallen rock or pieces of equipment. The secondary pulverizer would allow an operator to break up rocks or coal or other such objects which may have fallen into a position to jam or wedge the high-wall miner or push-beam conveyor. The bucket or scoop would allow an exterior operator to clear and remove even from the mine shaft debris which is causing the problem. The excavator hammer would allow an operator exterior to the mine shaft to break out rock and material from around the high-wall miner or the push-beam conveyor. Once this rock or other material is broken away from around the equipment, other implements could be used to further reduce the material or to remove it from the high-wall mine shaft.

Figure 2:
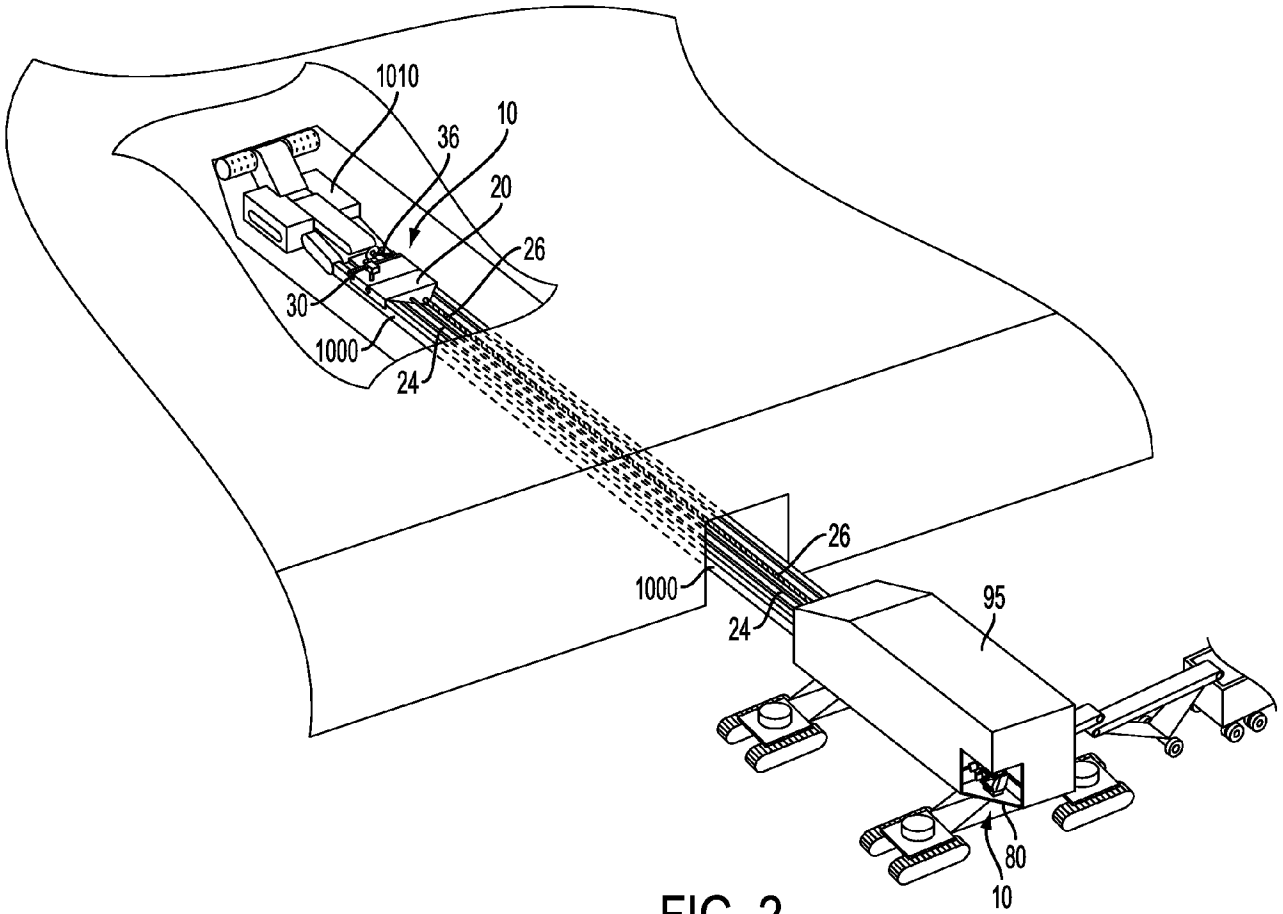
FIG. 2 is a perspective view of a high-wall mining operation with the equipment retrieval apparatus in position on the push-beam conveyor system and being operated from the high-wall miner control center.

FIG. 2 is a perspective view of a high-wall mining operation with the equipment retrieval system 10 in use. In the embodiment shown in FIG. 2, the equipment retrieval system is comprised of the equipment recovery vehicle 20, the communication cable 24, the wire rope 26, and operator station 80 located in high-wall miner control center 95. In FIG. 2, equipment recovery vehicle 20 has been placed on push-beam conveyor 1,000 as a track and sent back along push-beam conveyor 1,000 to the proximity of the mining machine. Communication cable 24 extends from equipment recovery vehicle 20 back to high-wall mining center 95 and is connected to operator station 80. Wire rope 26 also runs from equipment recovery vehicle 20 back to high-wall mining center 95 and a winch (not shown in this figure). From operator station 80, an operator may inspect the site inside the high-wall mine shaft via camera 30 and control and perform functions necessary for the given situation.

Figure 3:
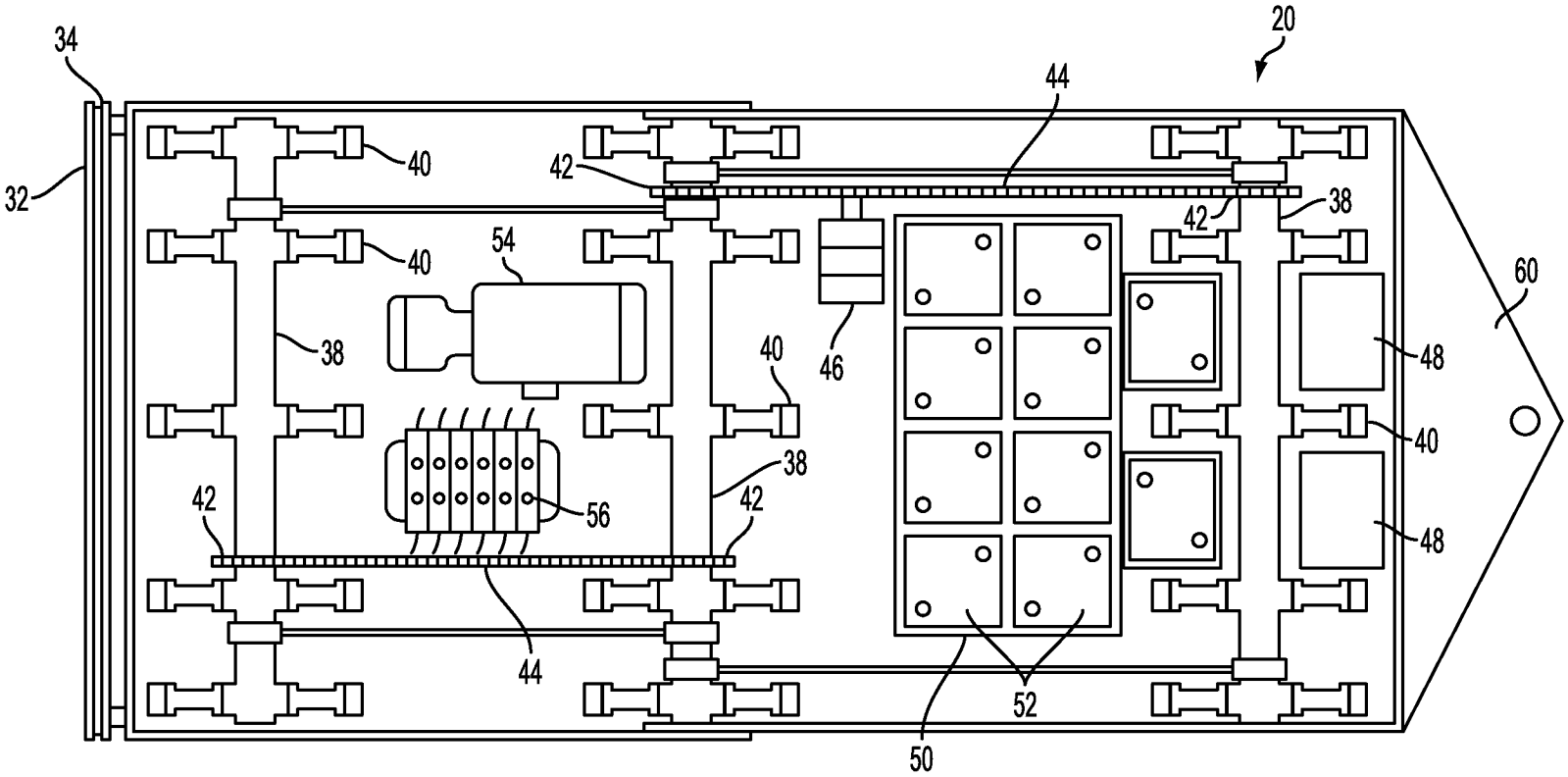
FIG. 3 is a top view of an embodiment of the tram portion of the equipment retrieval apparatus.

FIG. 3 is a top view of the interior of equipment recovery vehicle 20. In the embodiment of equipment recovery vehicle 20 shown in FIG. 3, there are three axels 38 with several wheels 40 mounted upon them. The center axel 38 is concentric with hinge 22. By placing center axel 40 concentric with hinge 22, all three axels will maintain their wheels in contact with the push-beam conveyor 1,000. FIG. 1 shows an axel 38 standing alone behind equipment recovery vehicle 20. Wheels 40 on axel 38 are spaced to ride on the top surface of push-beam conveyor 1000. Returning to FIG. 3, along with wheels 40, axels 38 have drive-sprockets 42 mounted on them. A drive-train chain 44 connects drive-sprockets 42 on the front axel and the center axel and a drive-train chain 44 connects sprockets 42 on the center axel and the back axel. A reversible hydraulic motor 46 drives the chain connected between the center and rear axels 40. In this way, all the axels 40 are driven at the same rate and due to the arrangements of the center axel 40 and hinge 22, all maintain contact with the push-beam conveyor 1,000.

At the right end of equipment recovery vehicle 20, in proximity to the connecting point of communication cable 24 are electrical control boxes 48. Electrical control boxes 48 contain the necessary processors, relays, switches, etc. to convert the instructions received over communications cable 24 to the actions desired by the operator. In at least one embodiment communications, cable 24 may be an Ethernet cable and in those cases, the electrical control boxes 48 will also comprise an Ethernet extender for boosting and filtering the signals over communications cable 24.

In the right hand portion of the equipment recovery vehicle 20, a battery tray assembly 50 is located. In FIG. 3 battery tray assembly 50 comprises a plurality of batteries 52, but it is conceivable that a single battery could be developed that would suffice. In addition to being the power source for the electricity for electrical control boxes 48, batteries 52 of battery tray assembly 50 power DC pump motor 54 located in the left hand section of equipment recovery vehicle 20.

Hydraulic pump 54 provides pressurized hydraulic fluid to multi-section control valve 56 which directs the flow of hydraulic fluid as instructed by the operator via communications cable 24. Multi-section control valve 56, for example, directs the direction of turning of hydraulic motor 46 which determines the direction of travel of equipment recovery vehicle 20 along push-beam conveyor 1,000. Multi-section control valve 56 will also direct and control the operation of hydraulic implements mounted to component mounting plate 32 at the front of equipment recovery vehicle 20. Multi-section control valve 56 also controls the position of component mounting plate 32 and the tilt of tilt plate 34.

Figure 4:
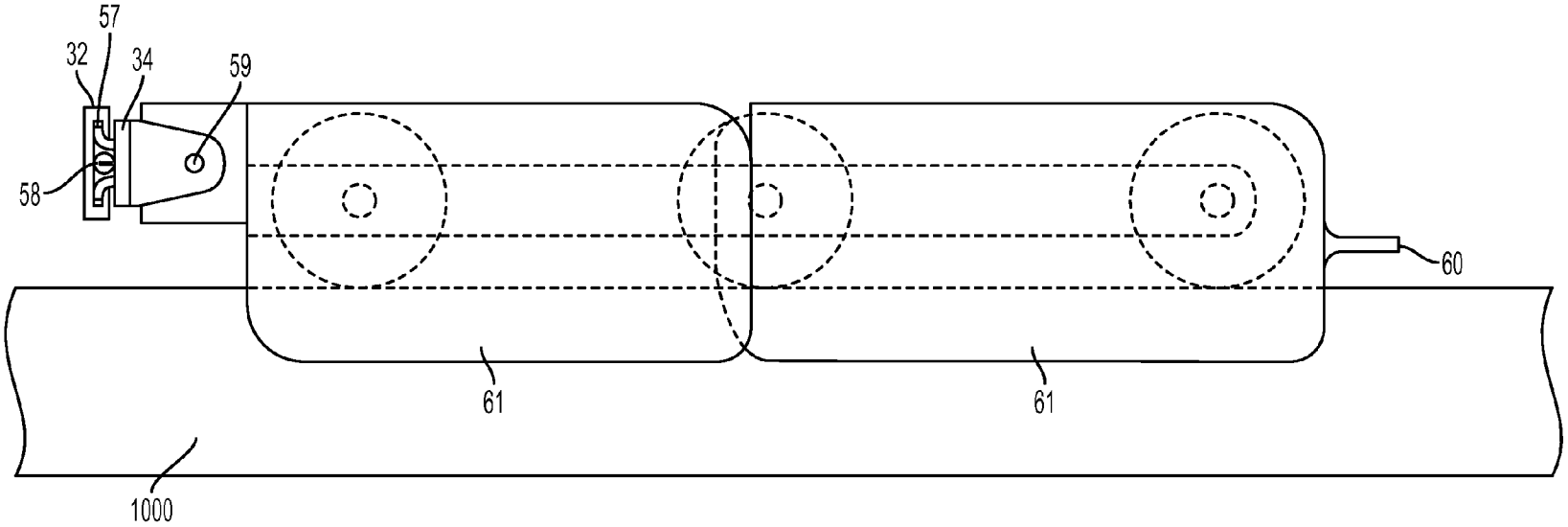
FIG. 4 is a side view of the tram of an embodiment of the tram portion of the equipment retrieval apparatus positioned on a push-beam.

FIG. 4 is a side view of equipment recovery vehicle 20 positioned on push-beam conveyor 1,000. At the front of equipment recovery vehicle 20, component mounting plate 32 and tilt plate 34 are positioned. Component mounting plate 32 is mounted on rails 57 on tilt plate 34. Cylinder 58, located between component mounting plate 32 and tilt plate 34 and connected between them, provides the means for moving component mounting plate 32 back and forth. Pivot 59 is the pivot about which tilt plate 34 can rotate to change the angle presented by component mounting plate 32 and tilt plate 34. At the right in FIG. 4 hitch plate 60 extends out and provides a connection point for wire rope 26 as well as communications cable 24. Hitch plate 60 is also shown in FIGS. 1 and 3.

In this side view of FIG. 4, it can be seen that sides 61 extend down below the top of push-beam conveyor 1,000. This allows sides 61 to function as guides and maintain equipment recovery vehicle 20 on push-beam conveyor 1,000 as equipment recovery vehicle 20 travels back and forth. Two separate side plates are visible in FIG. 4 due to the segmented construction of equipment recovery vehicle 20. As discussed before in the embodiment shown in FIG. 4, equipment recovery vehicle 20 is hinged toward the middle of its body.

Figure 5:
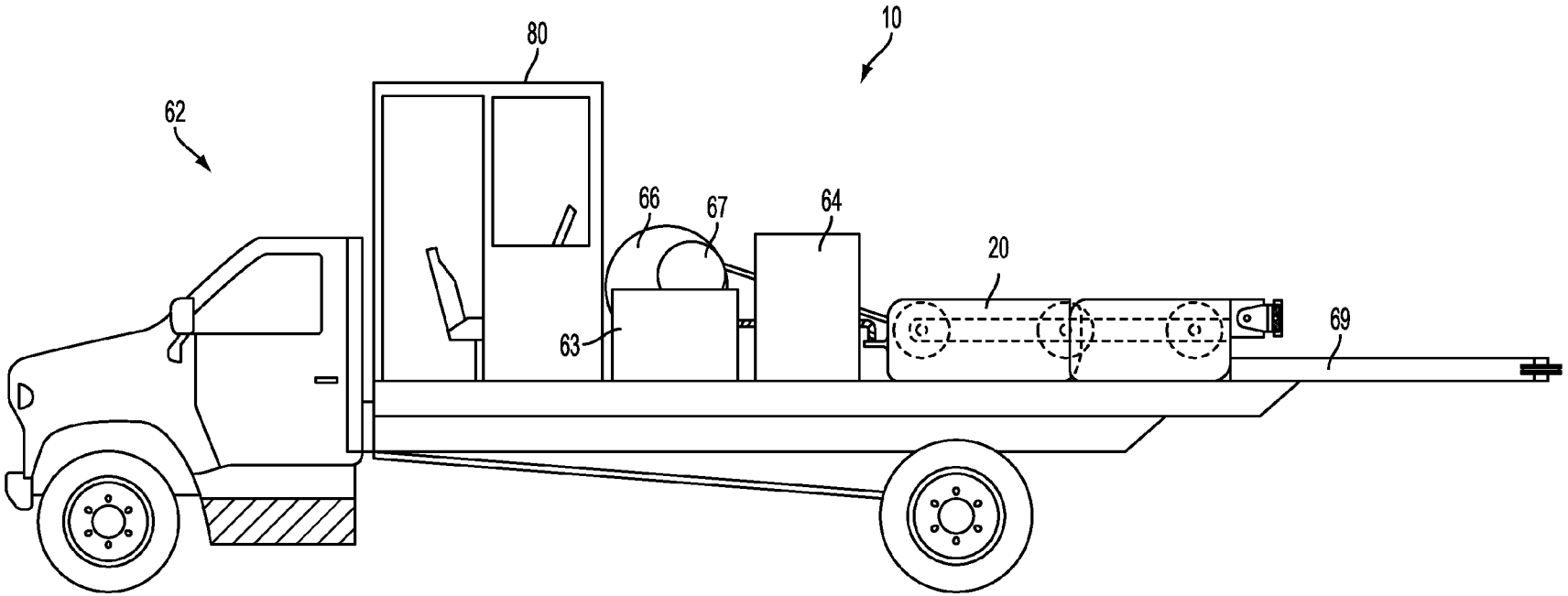
FIG. 5 is a side view of a transportation vehicle portion of an embodiment of the equipment retrieval apparatus.
Figure 6:
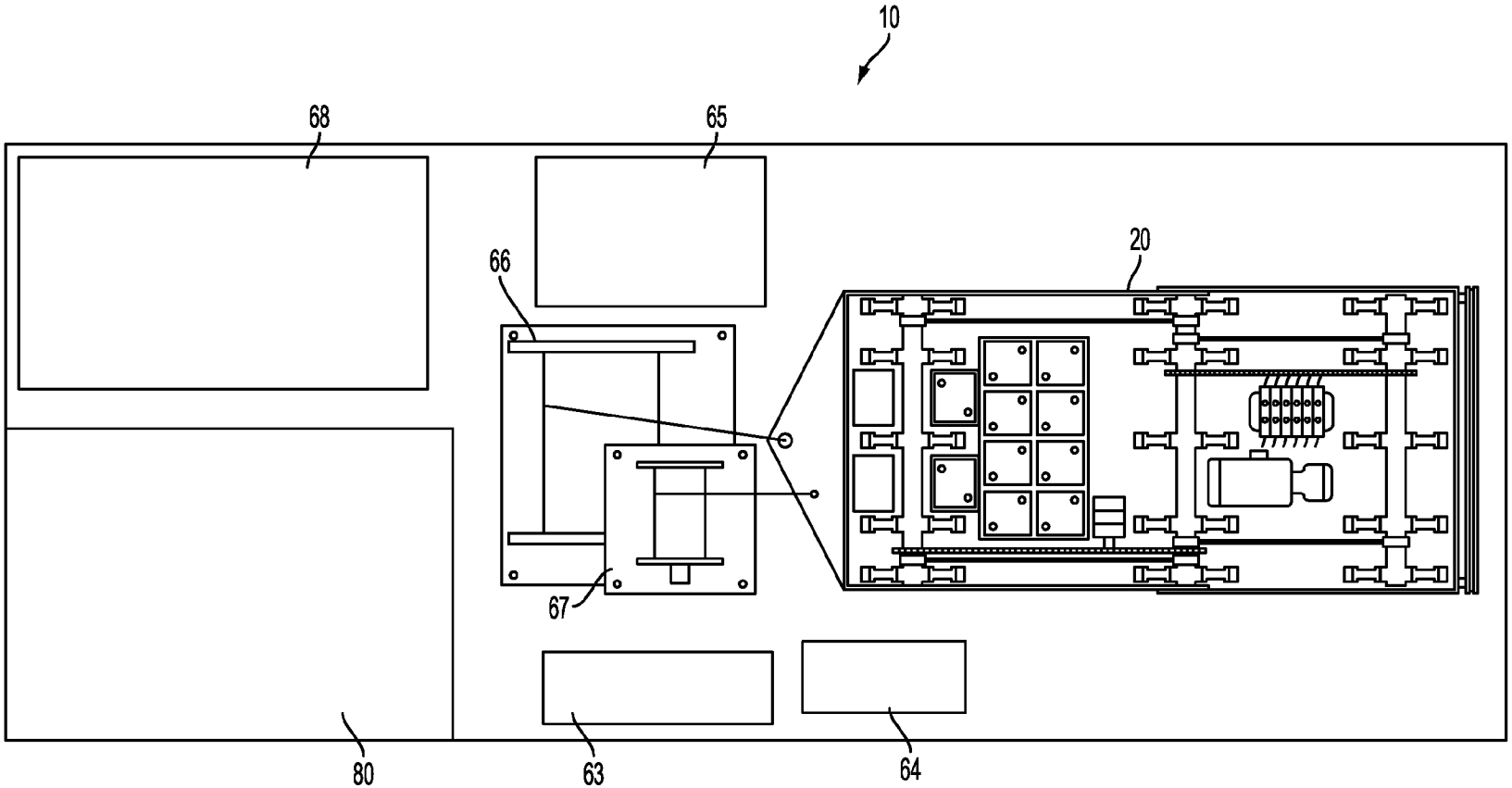
FIG. 6 is a top view of the bed of an embodiment of the equipment retrieval system.

FIG. 5 is a side view of an embodiment of self-propelled control vehicle 62. FIG. 6 is a top view of the bed of an embodiment of self-propelled control vehicle 62 such as in FIG. 5. In FIG. 2 equipment recovery vehicle 20 was operated from the operator station 80 within the high-wall miner control center 95. The self-propelled control vehicle 62 of FIG. 5 provides the function of the operator station 80 shown in FIG. 2 for an embodiment of equipment recovery system 10. Self-propelled control vehicle 62 in FIGS. 5 and 6 has an operator station 80, a power distribution center 63, step-down transformer 64, hydraulic power supply 65, winch 66 for wire rope 26, cable reel 67 for communications cable 24, and an electrical generator 68. Self-propelled control vehicle 62 also has space for loading and carrying equipment recovery vehicle 20.

In the embodiment in FIG. 5, self-propelled control vehicle 62 also has boom 69 extending horizontally from its bed. Boom 69 allows the wire rope 26 and the communications cable 24 to be directed at an angle so that self-propelled control vehicle 62 does not have to be parked directly in front of a high-wall mine shaft in order to operate. This would allow deployment of equipment recovery vehicle 20 without disconnecting external high wall miner control center 95 from push-beam conveyor 1000 and moving high wall miner control center 95.

Generator 68 provides power requirements for the elements of equipment recovery system 10 mounted on self propelled control vehicle 62 beyond those of the self propelled control vehicle 62 itself. Generator 68 provides electrical power, via power distribution center 63, to operator station 80 and its attendant electrical controls, batteries 52 in battery tray assembly 50 of equipment recovery vehicle 20, hydraulic power supply 65, and to winch 66 and cable reel 67, when they are powered by electricity. For some embodiments of self propelled control vehicle 62, winch 66 and cable reel 67 may be hydraulically powered. In those embodiments, hydraulic power supply 65 would supply the hydraulic power needed. Boom 69 may also be hydraulically powered.

Figure 7:
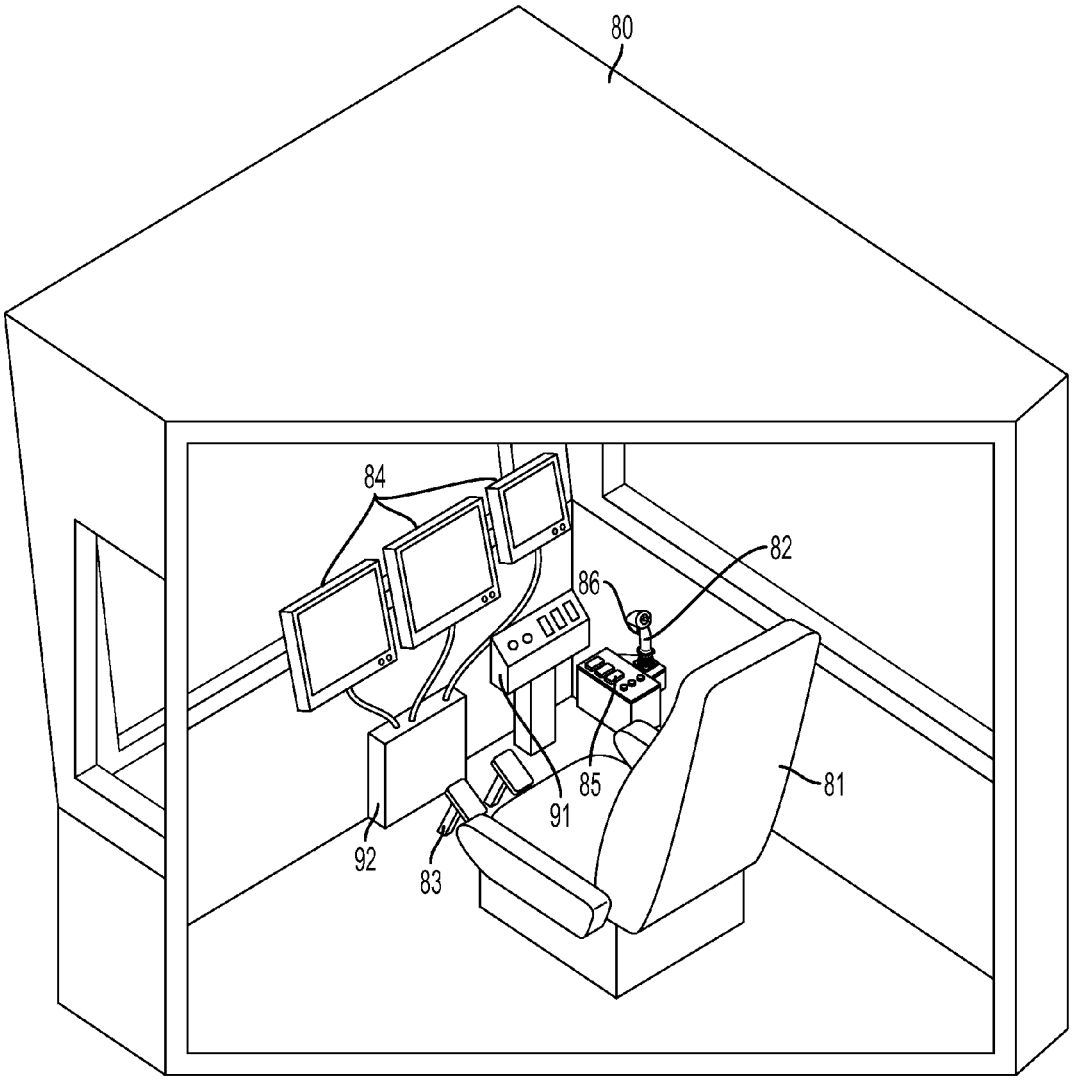
FIG. 7 is an embodiment of an operators control center for the equipment retrieval apparatus.

FIG. 7 is a cut away view of operator station 80 as it might be set up to facilitate the operation of equipment recovery vehicle 20 from the bed of self-propelled control vehicle 62 or within high-wall miner control center 95. Operator station 80 has a seat 81 for an operator and several control interfaces for the operator. Video displays 84 provide images from within the high-wall mine shaft, at least one of those images can be provided by camera 30 on equipment recovery vehicle 20. Pedals 83 can control the speed and direction of the equipment recovery vehicle 20, while joystick 82 allows the operator to operate implements or components mounted onto component mounting plate 32 on the front of equipment recovery vehicle 20. Programmable logic controller 91 in operator station 80 converts signals from the operator controls to the equivalent signals for the elements on equipment recovery vehicle 20. Programmable logic controller 91 also synchronizes the operation of winch 66, cable reel 67, and equipment recovery vehicle 20. For applications using Ethernet communications over communications cable 24, Ethernet extender 92 provides the processing and boosting capabilities needed.

Figure 8:
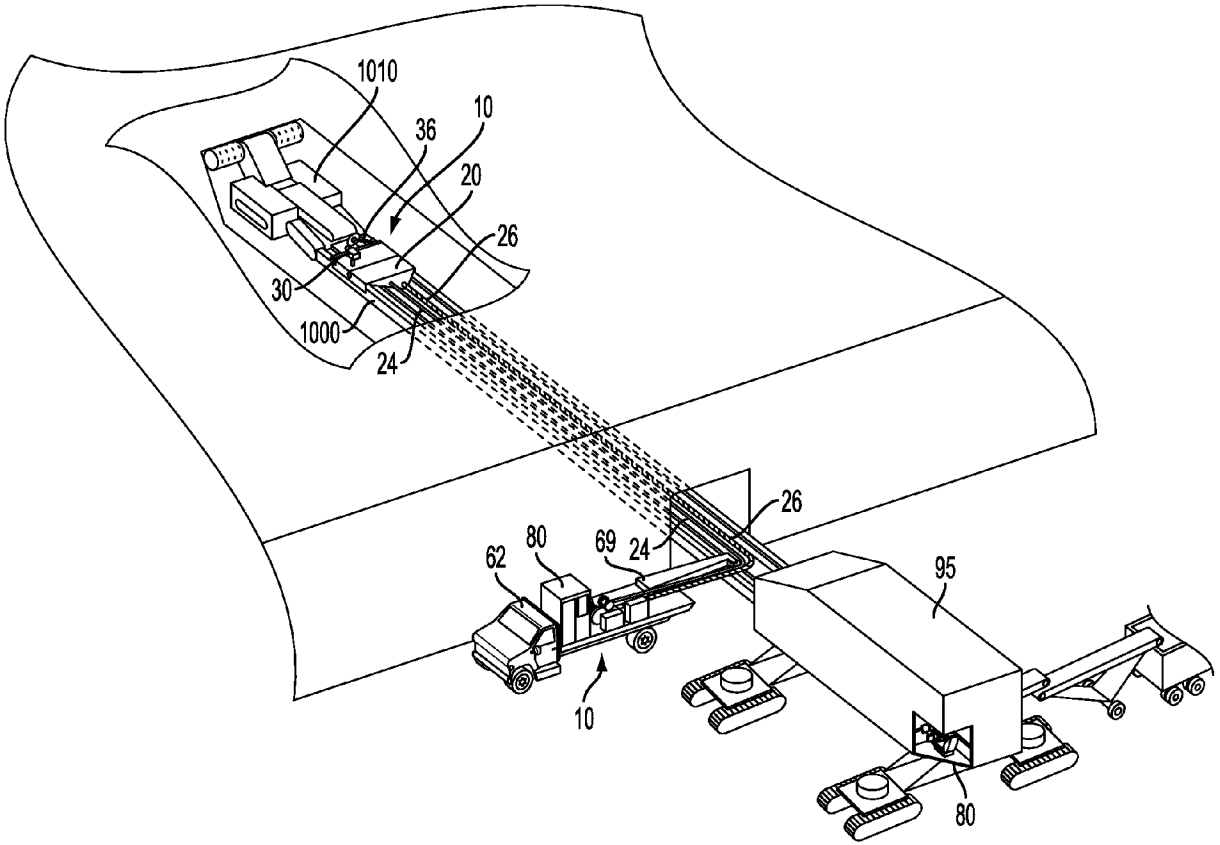
FIG. 8 is a perspective view of the equipment retrieval system with both the tram portion and the carrier vehicle portion.

FIG. 8 is a perspective view of a high-wall mining operation setup. In FIG. 8, self-propelled control vehicle 62 is backed up at an angle to push-beam conveyor 1,000 with boom 69 extended over push-beam conveyor 1,000. Equipment recovery vehicle 20 is on push-beam conveyor 1000 in the high-wall mine shaft in proximity to high wall mining machine 1010. Wire rope 26 and communication cable 24 run from equipment recovery vehicle 20 to boom 69 which then redirects it to winch 66 and cable reel 67 on the bed of self-propelled control vehicle 62.

Figure 9:
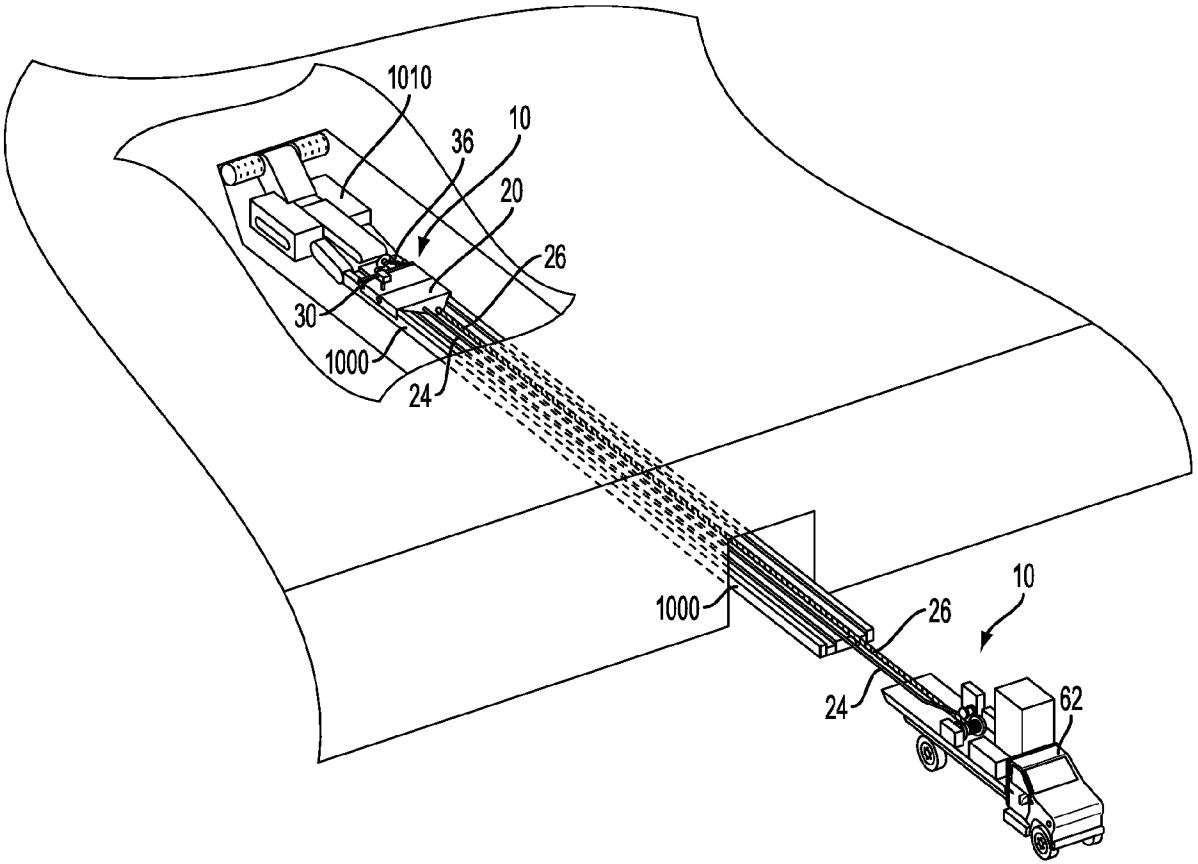
FIG. 9 is a perspective view of the high-wall mining operation with the high-wall miner control center removed and the equipment retrieval system in operation.

FIG. 9 is a perspective view of a mining machine 1010 and push-beam conveyor 1000 located in a high-wall mine shaft with the high-wall mine control center removed. Self-propelled control vehicle 80 is positioned at the end of push-beam conveyor 1,000. Equipment recovery vehicle 20 is located back in the mine shaft in proximity to mining machine 1010. Wire rope 26 and communications cable 24 run from equipment recovery vehicle 20 to self-propelled control vehicle 62 outside the mine.

Although specific embodiments of the invention have been described with specificity, the embodiments described should not be considered exhaustive of the possible embodiments of the invention and should not be held as limiting the scope and range of the claims. Similarly the drawings are not exhaustive depictions of embodiments of the invention and the abstract is intended to allow a person to quickly gain the general field of the invention and should not be taken as limiting the scope of the claims.

I claim:

1. A mine equipment recovery system comprising:

a recovery vehicle configured to ride on a push-beam conveyor in a mine, the push-beam conveyor having a top surface with two edges and two sides with one of the sides joined to the top surface at each edge, the top surface and two sides running the length of the conveyor and enclosing the working elements of the conveyor, the top surface and sides defining the width of the conveyor, said recovery vehicle comprising;

a body having a forward end and a rear end and two sides connecting said forward end and said rear end of said body;

a drive train mounted on said body, said drive train comprising an axle with a set of wheels, said set of wheels being spaced narrowly enough to ride on the top surface of the push-beam conveyor;

a guide on each said side of said body, each said guide extending downward from its respective side to below the level of the top surface of the push-beam conveyor maintaining said vehicle on the push beam conveyor;

electrical control boxes mounted on said body, said electrical control boxes comprising communication elements for receiving commands from outside of the mine and transmitting commands to other elements mounted on said body;

a power source mounted on said body, said power source powering said drive train and said electrical boxes;

an implement mount on said forward end of said body; and, a hitch on said rear end of said body, said hitch for retrieval of said recovery vehicle.

2. The mine equipment recovery system of claim 1, wherein:

said power source is a battery pack comprising at least one battery.

3. The mine equipment recovery system of claim 1, further comprising:

a hydraulic pump powered by said power source, said hydraulic pump pumping hydraulic fluid;

a multi-section control valve controlling the flow of said hydraulic fluid; and a hydraulic motor driven by said hydraulic fluid, said hydraulic motor powering said drive train.

4. The mine equipment recovery system of claim 1, further comprising:

an implement mounted to said implement mount.

5. The mine equipment recovery system of claim 4, wherein:

said implement is hydraulically powered and controlled through said multi-section control valve.

6. The mine equipment recovery system of claim 5, wherein:

said implement is a hydraulic cut-off saw.

7. The mine equipment recovery system of claim 1, further comprising:

an Ethernet extender among said electrical control boxes and an Ethernet cable connected to said Ethernet extender, said Ethernet cable transmitting said commands from outside of the mine.

8. The mine equipment recovery system of claim 1, further comprising;

a camera mounted to the exterior of said body, said camera transmitting mine images to said control boxes and said control boxes transmitting the mine images to outside of the mine.

9. The mine equipment recovery system of claim 1, further comprising;

a retrieval line fastened to said hitch.

10. The mine equipment recovery system of claim 1, further comprising;

a horizontal hinge in said body between said forward end and said rear end;

said drive train comprising a first axle mounted coaxially with said hinge, a second axle mounted toward said forward end from said first axle, and a third axle mounted toward said rear end from said first axle, each said axle having a set of wheels spaced to ride on said push-beam conveyor.

11. The mine equipment recovery system of claim 1, further comprising;

an operator station outside the mine, said operator station comprising information displays, operator interfaces, and electrical control boxes to transmit commands to said recovery vehicle.

12. The mine equipment recovery system of claim 11, wherein;

said operator station is located at a high wall miner control center.

13. The mine equipment recovery system of claim 12, further comprising;

a self-propelled surface vehicle outside the mine, said self propelled vehicle comprising;

a generator, a power distribution center, a hydraulic power supply, a retrieval wench for retrieving said recovery vehicle, a reel for communication cable and said operator station.

14. The mine equipment recovery system of claim 13, further comprising;

a boom on said self-propelled surface vehicle.

15. A mine equipment recovery system comprising:

a recovery vehicle configured to ride on a track in a mine, said recovery vehicle comprising;

a body having a forward end and a rear end;

a drive train mounted on said body, said drive train comprising an axle with a set of wheels, said set of wheels being spaced to ride on the track; a guide on said body, said guide maintaining said vehicle on the track;

electrical control boxes mounted on said body, said electrical control boxes comprising communication elements for receiving commands from outside of the mine and transmitting commands to other elements mounted on said body;

a power source mounted on said body, said power source powering said drive train and said electrical boxes;

an implement mount on said forward end of said body; and, a hitch on said rear end of said body, said hitch for retrieval of said recovery vehicle.

16. The mine equipment recovery system of claim 15, wherein;

the track is a push-beam conveyor.

17. The mine equipment recovery system of claim 15, further comprising;

an operator station outside the mine, said operator station comprising information displays, operator interfaces, electrical control boxes, and an Ethernet extender among said control boxes in said operator station;

an Ethernet extender among said electrical control boxes in said body; and, an Ethernet cable connected between the Ethernet extender of the operator station and the Ethernet extender of the body.

18. The mine equipment recovery system of claim 17, wherein;

said operator station is located at a high wall miner control center.

19. The mine equipment recovery system of claim 17, wherein;

said operator station is located on a self-propelled surface vehicle.

* * * * *